US005933391A

United States Patent [19]

Uptegraph

[11] Patent Number: 5,933,391

[45] Date of Patent: Aug. 3, 1999

[54] TIMER

[75] Inventor: Greg S. Uptegraph, Clementon, N.J.

[73] Assignee: Lux Products Corporation, Mt. Laurel, N.J.

[21] Appl. No.: 08/896,891

[22] Filed: Jul. 18, 1997

[51] Int. Cl.[6] ..... G04C 17/00

[52] U.S. Cl. ..... 368/69; 368/187

[58] Field of Search ..... 368/89–113, 69, 368/187

[56] References Cited

U.S. PATENT DOCUMENTS

| | | | |
|---|---|---|---|
| 405,206 | 6/1889 | Dubinski . | |
| 3,596,460 | 8/1971 | Wuthrich . | |
| 3,646,751 | 3/1972 | Purland et al. | 368/108 |
| 4,253,177 | 2/1981 | Hafner | 368/187 |
| 4,257,115 | 3/1981 | Hatuse et al. . | |
| 4,338,681 | 7/1982 | Rapp et al. . | |
| 4,374,622 | 2/1983 | Kashio . | |
| 4,432,652 | 2/1984 | Munekata et al. . | |
| 4,451,159 | 5/1984 | Tanaka | 368/69 |
| 4,504,154 | 3/1985 | Kammerer . | |
| 4,618,264 | 10/1986 | Kamens et al. . | |
| 4,678,344 | 7/1987 | Inoue | 368/69 |
| 4,837,731 | 6/1989 | Levine et al. | 368/187 |

FOREIGN PATENT DOCUMENTS

| | | | |
|---|---|---|---|
| 75286 | 4/1986 | Japan | 368/187 |

*Primary Examiner*—Bernard Roskoski
*Attorney, Agent, or Firm*—Austin R. Miller

[57] ABSTRACT

A timer is provided with a setting member which is moved in order to set, increase or decrease a desired countdown time. Movement of the setting member in one direction generates an increment pattern and movement in an opposite direction generates a decrement pattern. A bit generator is connected to increment or decrement the countdown time.

20 Claims, 11 Drawing Sheets

TIMER

BACKGROUND OF THE INVENTION

This invention relates to a timer. In particular, it relates to a time setting mechanism for an electronic countdown timer.

FIELD OF THE INVENTION

It is desirable for timers to be easy and convenient to use. For example, simplicity of use is especially desirable for countdown timers that are intended to be used while other tasks are being performed, such as countdown timers that are used in the kitchen while the user is cooking or baking. Such timers should be easy to set. It is also desirable for such timers to be adjustable so that the set time can be quickly and easily increased or decreased, as needed.

For example, a mechanical countdown timer is available from Lux Products Corporation of Mt. Laurel, N.J., under the registered trademark MINUTE MINDER®. It is characterized by ease of use. A knob centered on the face of the timer is provided with a scale of minutes around its perimeter. A user simply turns the knob to align a desired countdown time on the knob with a marker on the timer's face. After countdown begins, the knob returns under the action of a spring and gear mechanism until the time elapses. The countdown time can be easily adjusted by the user during countdown to increase or decrease the countdown time or to turn the timer off, if desired.

Various electronic timers have been proposed over the years. For example, Kashio U.S. Pat. No. 4,374,622 describes a digital alarm timepiece with a pointer to indicate a set alarm time. A coincidence circuit compares the set alarm time with the current time and, when they coincide, the coincidence circuit drives an audible alarm.

Kamens et al U.S. Pat. No. 4,618,264 describes an alarm setting device for a timepiece having a hand for indicating time passage. A marker is aligned with the hand in a first position. The number of clicks is counted and stored as the marker is rotated to a second position, and the alarm is actuated when the count of an up/down counter is equal to zero.

Nevertheless, there remains a demand for electronic timers that are simple to use and that can be easily set to a desired countdown time.

OBJECTS OF THE INVENTION

Accordingly, it is an object of this invention to provide an electronic timer that is easy to use.

It is another object of this invention to provide an electronic countdown timer that can be adapted to adjust a countdown time.

Other objects will be apparent in view of the description.

SUMMARY OF THE INVENTION

A timer is provided for selection of a countdown time. The timer includes a body and a setting member attached for movement with respect to the body. The timer also includes a bit generator circuit. The setting member generates a pattern of opened and closed circuits as the setting member is moved with respect to the body. The pattern of opened and closed circuits generates a countdown time by means of the bit generator. The setting member can be moved with respect to the body to generate an increment pattern to increase the countdown time while movement in the opposite direction can generate a decrement pattern to decrease the countdown time.

DETAILED DESCRIPTION OF THE INVENTION

Figure 1:
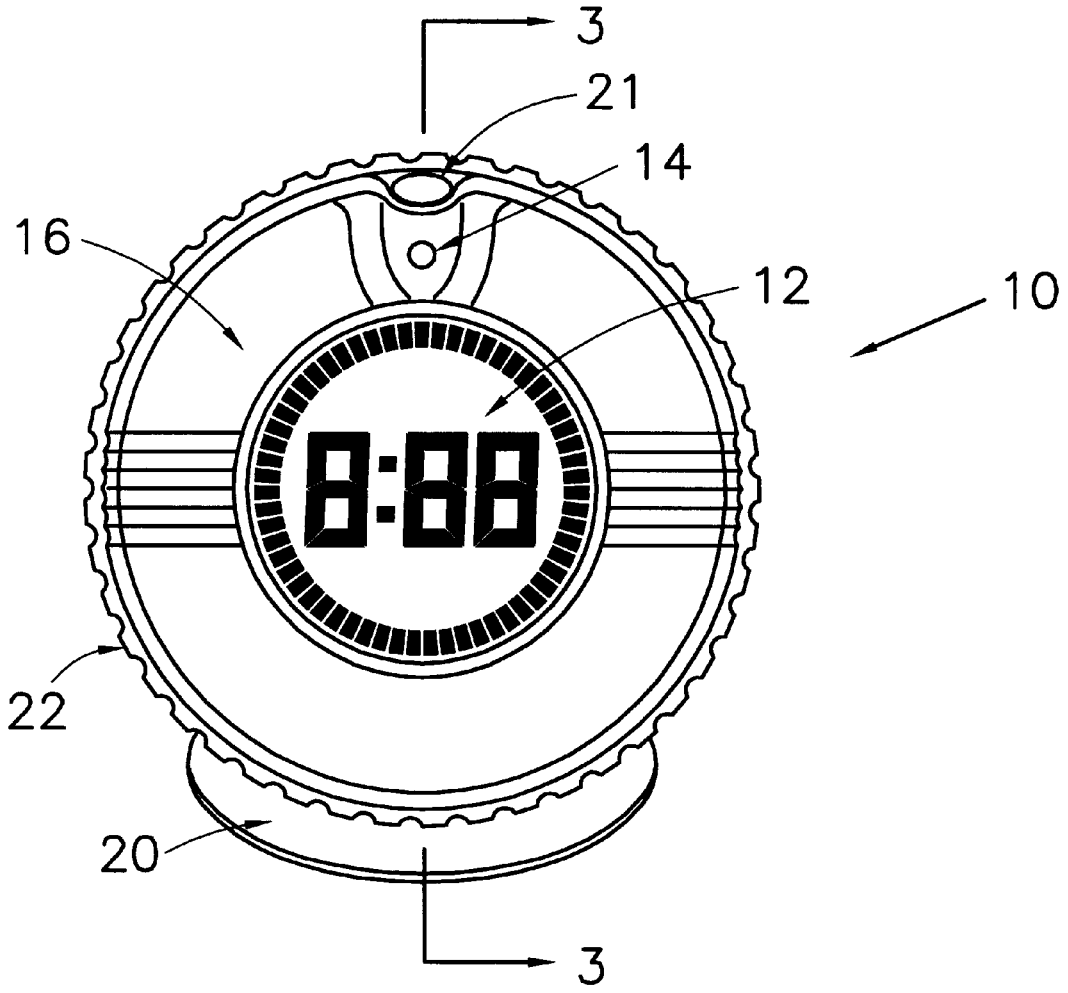
FIG. 1 is a front view of an embodiment of a timer according to this invention.

This invention is described with reference to an embodiment selected for illustration in the drawings. It will be appreciated that the spirit and the scope of this invention are not limited to the embodiment selected for illustration and that the drawings are not necessarily to scale. Instead, the invention is defined separately in the appended claims.

Figure 11:
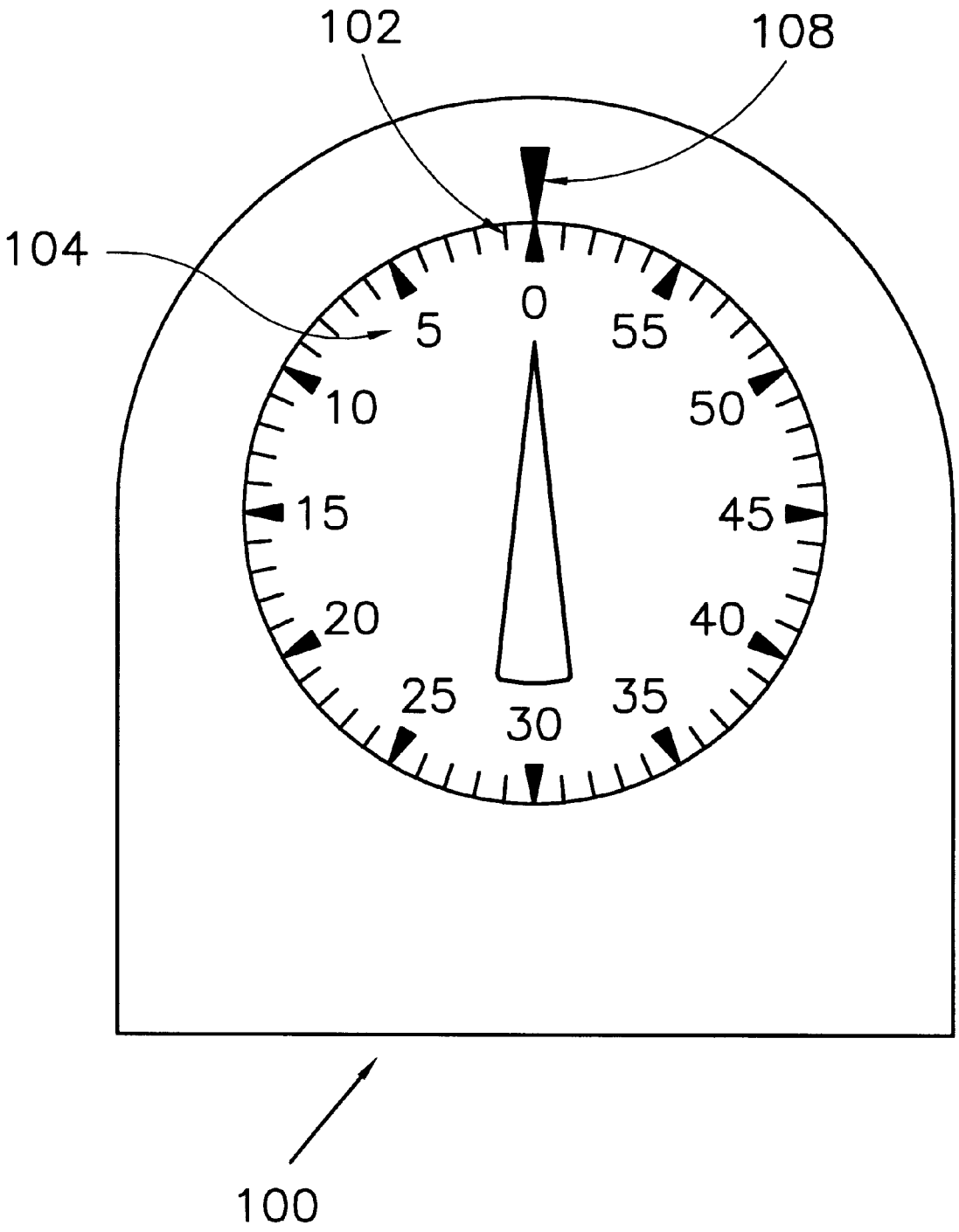
Fig. 11 PRIOR ART
FIG. 11 illustrates a prior art timer.

FIG. 11 illustrates a convention mechanical timer, labeled "PRIOR ART," as a point of reference for describing a timer according to this invention. It is similar to the timer available under the registered trademark MINUTE MINDER® from Lux Products Corporation. Timer 100 is a mechanical timer that operates based on mechanical coupling between a main spring and a gear train (not shown). Tick marks 102 and numerals 104 are positioned around the perimeter of a centrally mounted knob 106 to indicate a countdown time. Clockwise rotation of knob 106 increases the set countdown time and counter-clockwise rotation reduces the set countdown time.

In operation, the user of timer 100 would turn knob 106 clockwise until a desired countdown time is aligned with a marker 108 on the timer's face. Upon release, the main spring and gears turn knob 106 in the counter-clockwise direction until "0" reaches the mark 108 and a bell rings. During such operation, the user could rotate knob 106 to increase or decrease the remaining time, if desired.

Conventional timers such as mechanical timer 100 are easy to use. Nevertheless, the advent of cost effective electronics components has created a demand for an electronic timer that is also easy to use.

Figure 2:
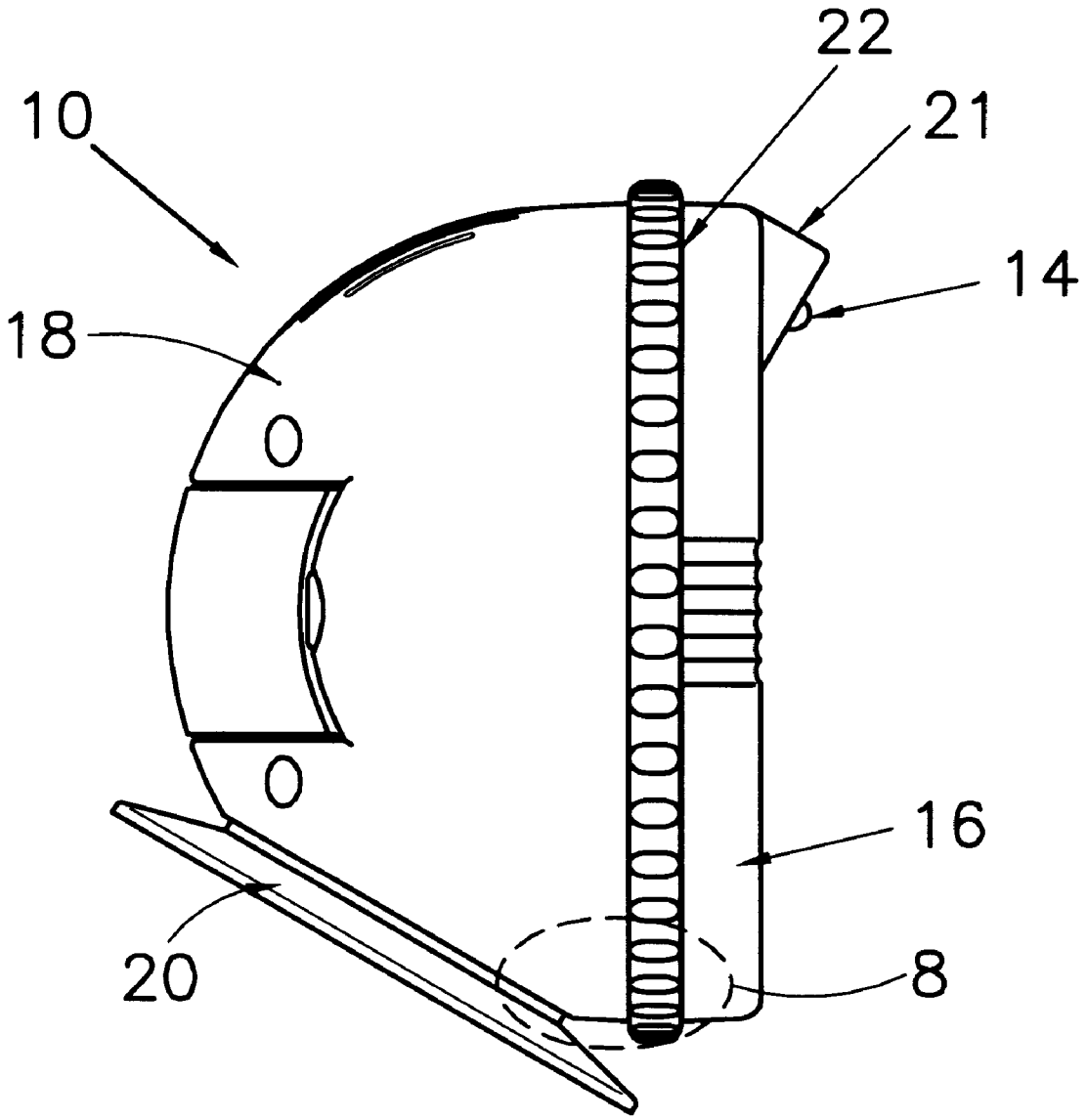
FIG. 2 is a side view of the timer embodiment shown in FIG. 1.

Referring to FIGS. 1 and 2, an embodiment of a timer according to this invention is generally designated by the numeral "10". Timer 10 is well adapted for use in kitchens for setting a cooking or baking countdown time. It will be appreciated that timer 10 can also be used in a wide variety of other applications such as in a photographic darkroom or any other application where it is desirable to set a countdown time (e.g. exercising, sunning, applying cosmetics, laundry, watering, telephone calls, etc.).

Timer 10 is provided with a liquid crystal display (or LCD) 12 that indicates a set countdown time as well as an elapsing countdown time. In the specific embodiment selected for illustration in FIG. 1, LCD 12 ornamentally displays the number of remaining hours to the left of a colon and the number of remaining minutes to the right of the colon. Seconds are ornamentally displayed around the periphery of the digital display of hours and minutes. Most preferably, each segment of the LCD display positioned around the periphery represents about one second of time. As time elapses, the segments disappear ornamentally in a counter-clockwise direction to symbolize the lapse of seconds. After the associated minute has elapsed, new segments are activated which, in turn, sequentially and ornamentally disappear in the same manner. Ornamental features of the timer display are further described in co-pending U.S. Design patent application Ser. No. 29/066,285.

Timer 10 also includes a visual alarm such as a light-emitting diode (or LED) 14. After the set countdown time elapses, a visual alarm in the form of LED 14 flashes and an audible alarm (not shown in FIG. 1) is sounded. Other configurations for the visual and audible alarms are of course contemplated.

Figure 8:
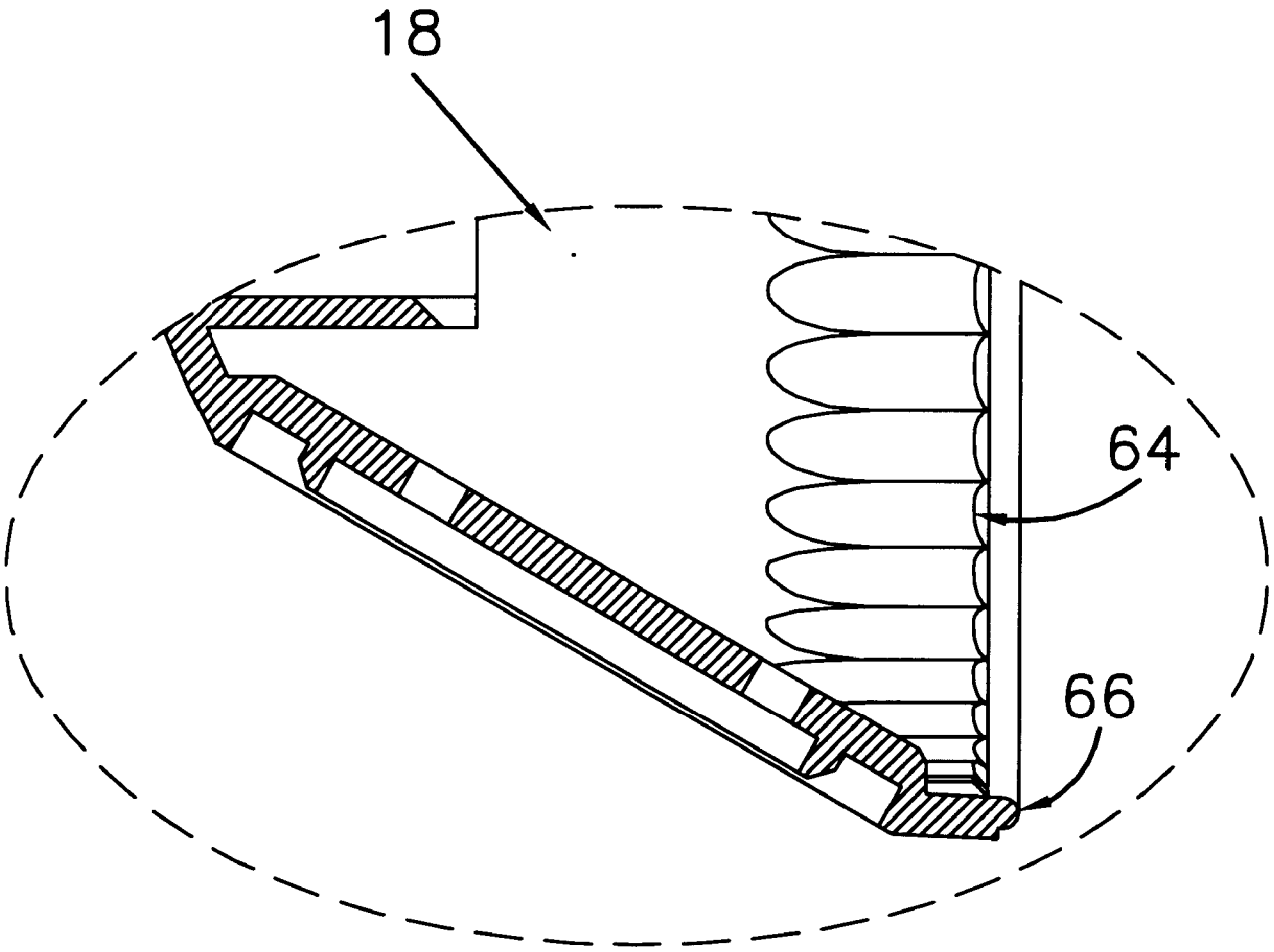
FIG. 8 is a partial cross-sectional side view of the timer embodiment shown in FIG. 2.

Timer 10 includes a front housing 16 and a back housing 18, details of which will be described later with reference to FIGS. 3 and 8. Attached to back housing 18 is a foot switch 20 which is movable with respect to the remainder of timer 10 by depressing a finger rest 21 located near the top of timer 10 on front housing 16. Foot switch 20 and finger rest 21 co-act to deactivate the timer alarms and to pause the timer while it is in the countdown mode, as desired. Most preferably, foot switch 20 is spring-biased away from back housing 18 so that pressure applied against finger rest 21 lowers the timer's housing and depresses an internal pressure-actuated switch (see FIGS. 3 and 4).

Also provided on timer 10 is a setting member or setting dial 22, details of which will be described later with reference to FIGS. 5 and 6. Setting dial 22 is captured between the front housing 16 and back housing 18 of timer 10 and setting dial 22 is adapted for rotation in a clockwise and a counter-clockwise direction with respect to the face of timer 10. Various components of timer 10, such as the front housing 16, setting dial 22, back housing 18 and foot switch 20 are preferably formed from a plastic material such as ABS. Ornamental features of the body of timer 10 are described in co-pending U.S. Design patent application Ser. No. 29/066,284.

External operation of timer 10 will now be described with reference to FIGS. 1 and 2. It is with setting dial 22 that the countdown time displayed by timer 10 is set, increased, or decreased, depending on the user's preference. Clockwise rotation of setting dial 22 with respect to the face of timer 10 increments the countdown time that is displayed by LCD 12. Conversely, counter-clockwise rotation of setting dial 22 with respect to the face of timer 10 decrements the displayed countdown time. Such rotation changes the display in one minute increments and decrements. After setting dial 22 is rotated until a desired countdown time is displayed, and after a preset delay such as two seconds elapses, a countdown mode is initiated to decrement the displayed countdown time.

During countdown, sixty segments representing seconds are ornamentally arranged around a 360 degree circle around the display. Starting from the top of the display, one segment will disappear in a counter-clockwise fashion for each second elapsed. When one minute has elapsed, the display will decrement by one minute and the sixty segments will reappear. When one hour has elapsed, if applicable to the selected time setting, the hours segment will decrement one hour and minutes will start again at "59". When the countdown time has reached zero, the alarm sounds and the LED 14 flashes for ten seconds or until the foot switch is depressed. The alarm sound is preferably a "Beep" sound which is most preferably driven by a piezo buzzer with a preferred minimum of 80 dB sound at a 1 foot distance.

Figure 3:
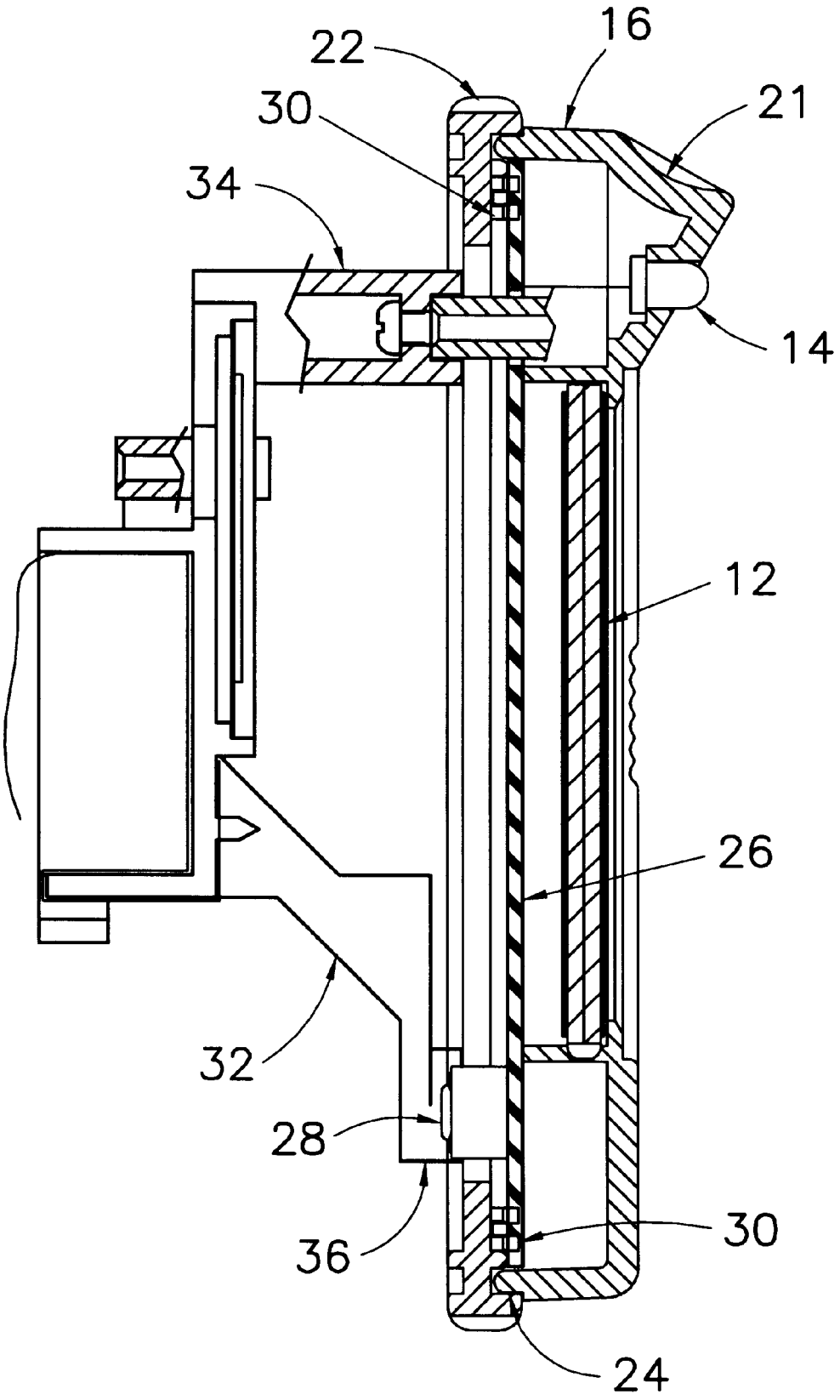
FIG. 3 is a partial cross-sectional side view of the timer embodiment shown in FIG. 1, with the back of the timer housing removed to reveal internal details.

The countdown is paused by depressing finger rest 21 to push timer 10 downward against foot switch 20 to activate the internal pressure switch (shown in FIG. 3). By pressing down once on the timer during countdown, the timer will stop counting and will preferably flash the countdown time at a rate of 1 Hz. To resume countdown, the timer is pressed down once again. The countdown will resume and the display will stop flashing. During timer pause, if the time needs to be adjusted, the dial is simply rotated until the desired countdown time is achieved.

The set countdown time can be increased during countdown mode by rotating setting dial 22 in a clockwise direction, thereby incrementing the countdown time. Likewise, the set countdown time can also be decreased during countdown mode by rotating setting dial 22 in a counter-clockwise direction to decrement the countdown time.

A countdown can be canceled and the timer can be turned off during countdown mode, if desired. During a countdown, rotation of the dial in a counter-clockwise direction until "0:00" is in the display will cancel the countdown. When "0:00" is reached by turning the dial, the 60 second segments or whatever portion of them is currently displayed will immediately disappear. The alarm will not sound and the LED will not flash.

Accordingly, the basic external operation of timer 10, from the perspective of the user, is analogous to the operation of prior art timer 100. In both timers, the user simply causes clockwise rotation of a component to increase the countdown time or causes counter-clockwise rotation to decrease the countdown time. As with timer 100, timer 10 can be easily adjusted "on the fly" while countdown is underway.

Referring now to FIG. 3, which provides a cross-sectional view from the side of timer 10, back housing 18 has been removed to reveal additional features. Mounted within timer 10 and preferably attached to front housing 16 is a printed circuit board 26 on which a pressure switch 28 is mounted. It is this pressure switch 28 that is actuated by depressing finger rest 21 to advance the foot switch 20 into the interior of timer 10 and into contact with the switch 28.

FIG. 3 reveals that front housing 16 includes a front housing edge portion 24 which fits within a groove provided in setting dial 22, as will be described further with reference to FIGS. 5 and 6. Mounted on setting dial 22 are two bit generator contacts 30 which are most preferably separated from one another by about 180°. Details of bit generator contacts 30 are described later with reference to FIGS. 7A and 7B. As is clear in FIG. 3, bit generator contacts 30 on setting dial 22 are positioned adjacent to printed circuit board 26 for continuous contact as setting dial 22 is rotated with respect to timer 10.

A mounting bracket 32 is connected by screws to front housing 16. Mounting bracket 32 includes two upper bosses 34 (only one shown) and two lower bosses 36 (only one shown) which are positioned to capture setting dial 22 in order to hold bit generator contacts 30 in continuous contact with the printed circuit board 26, while permitting rotation of setting dial 22 with respect to the face of timer 10. Mounting bracket 32 is also adapted to house the batteries that power timer 10.

Figure 4:
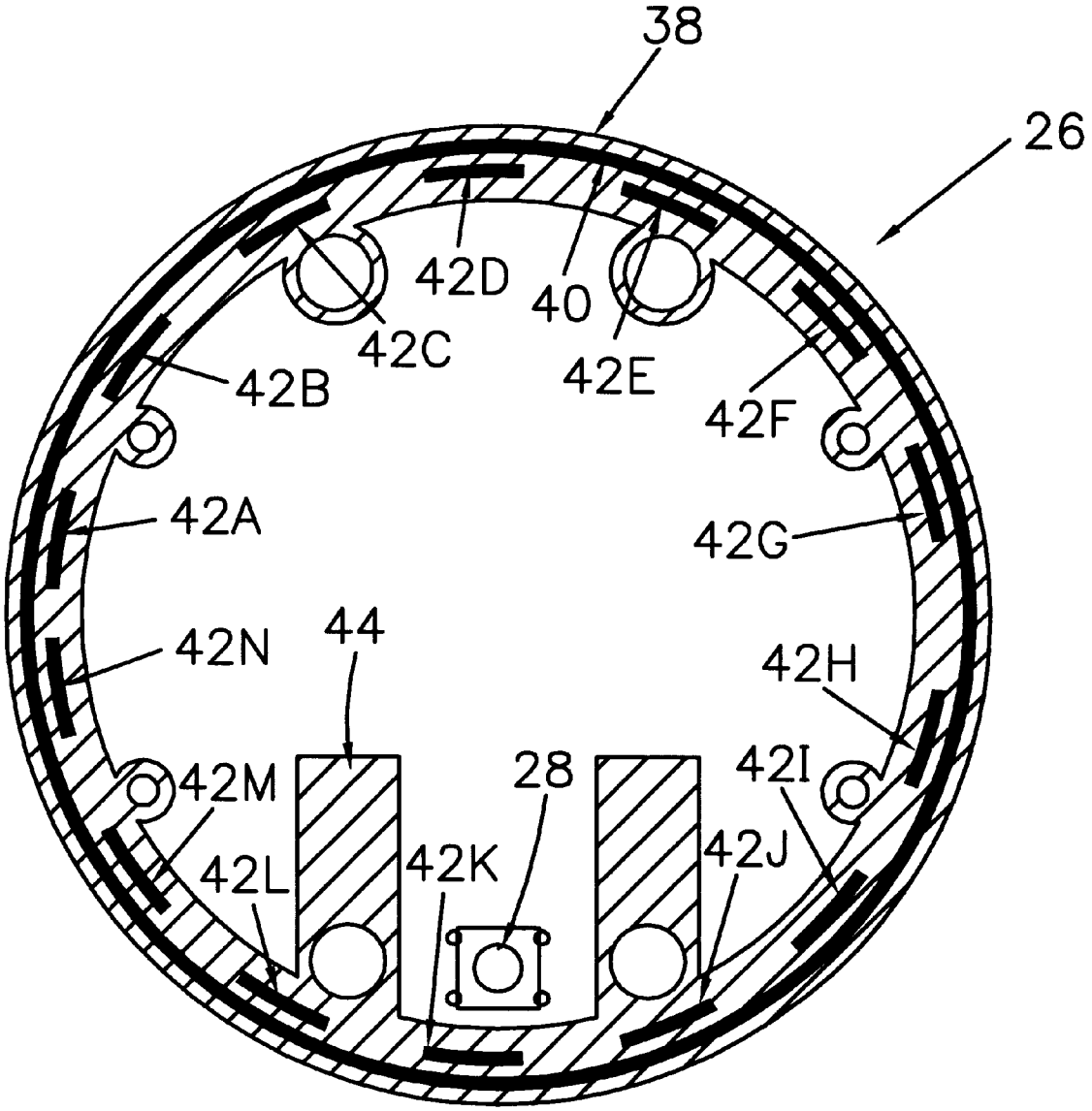
FIG. 4 illustrates an embodiment of a printed circuit board adapted for use in the timer embodiment shown in FIG. 1.
Figure 9:
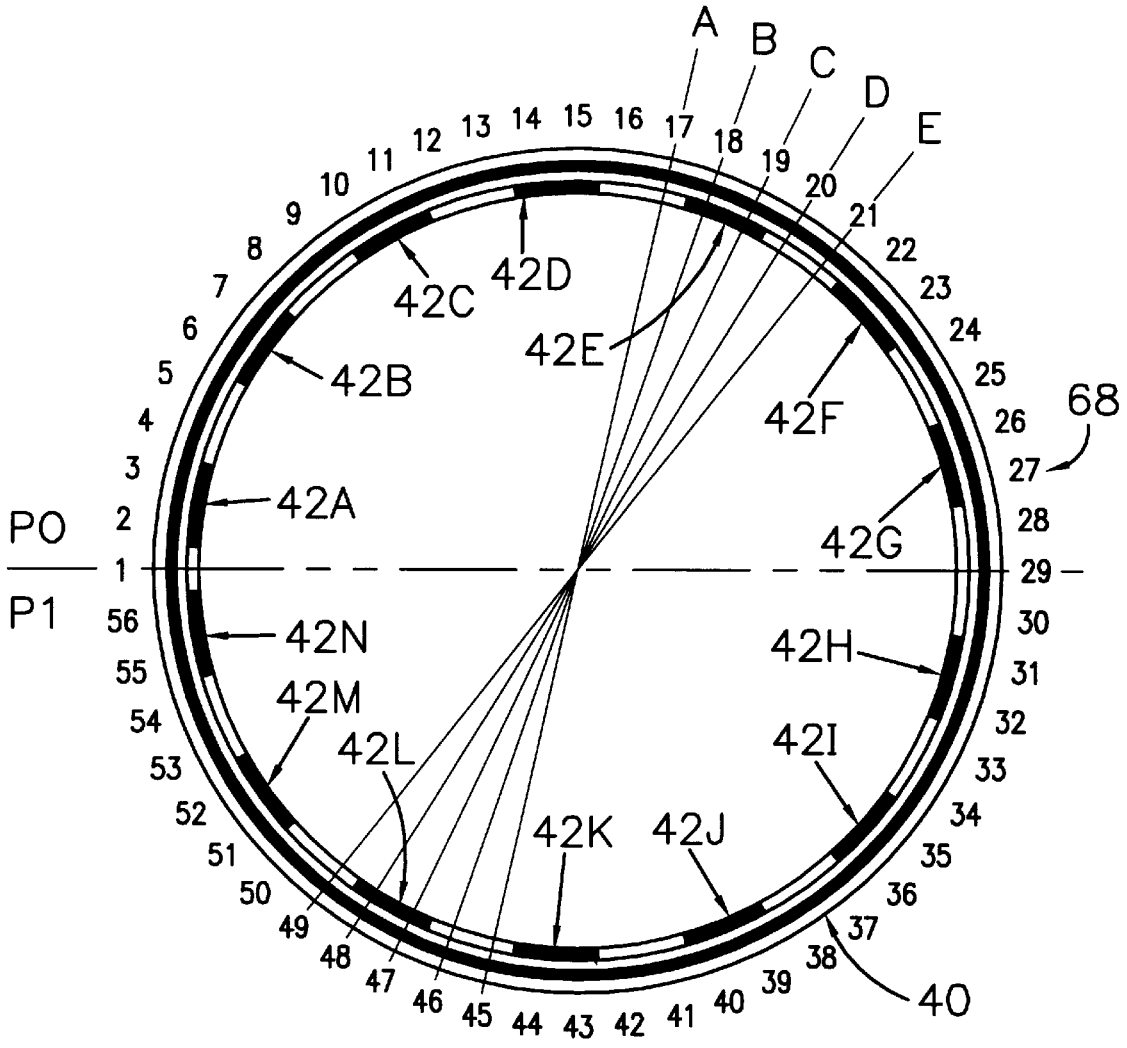
FIG. 9 illustrates an embodiment of a bit generator pattern adapted for use in the printed circuit board embodiment shown in FIG. 4.

Referring now to FIG. 4, a view of printed circuit board 26 reveals details of a bit generator pattern 38 formed on a surface of the printed circuit board. Bit generator pattern 38 includes a continuous electrical conductor 40 that is formed near the outer edge of printed circuit board 26. Adjacent to, and toward the interior of continuous electrical conductor 40, is a series of fourteen spaced conductors labeled 42A through 42N. As will be described in further detail with reference to FIG. 9, spaced conductors 42A–42N are positioned in a predetermined configuration in order to translate rotational movement of setting dial 22 into a countdown time. A region 44 is indicated in cross-hatched lines in FIG. 4 to represent locations that are intended to be free of other components on the printed circuit board 26. FIG. 4 also illustrates the location of pressure switch 28.

Figure 5:
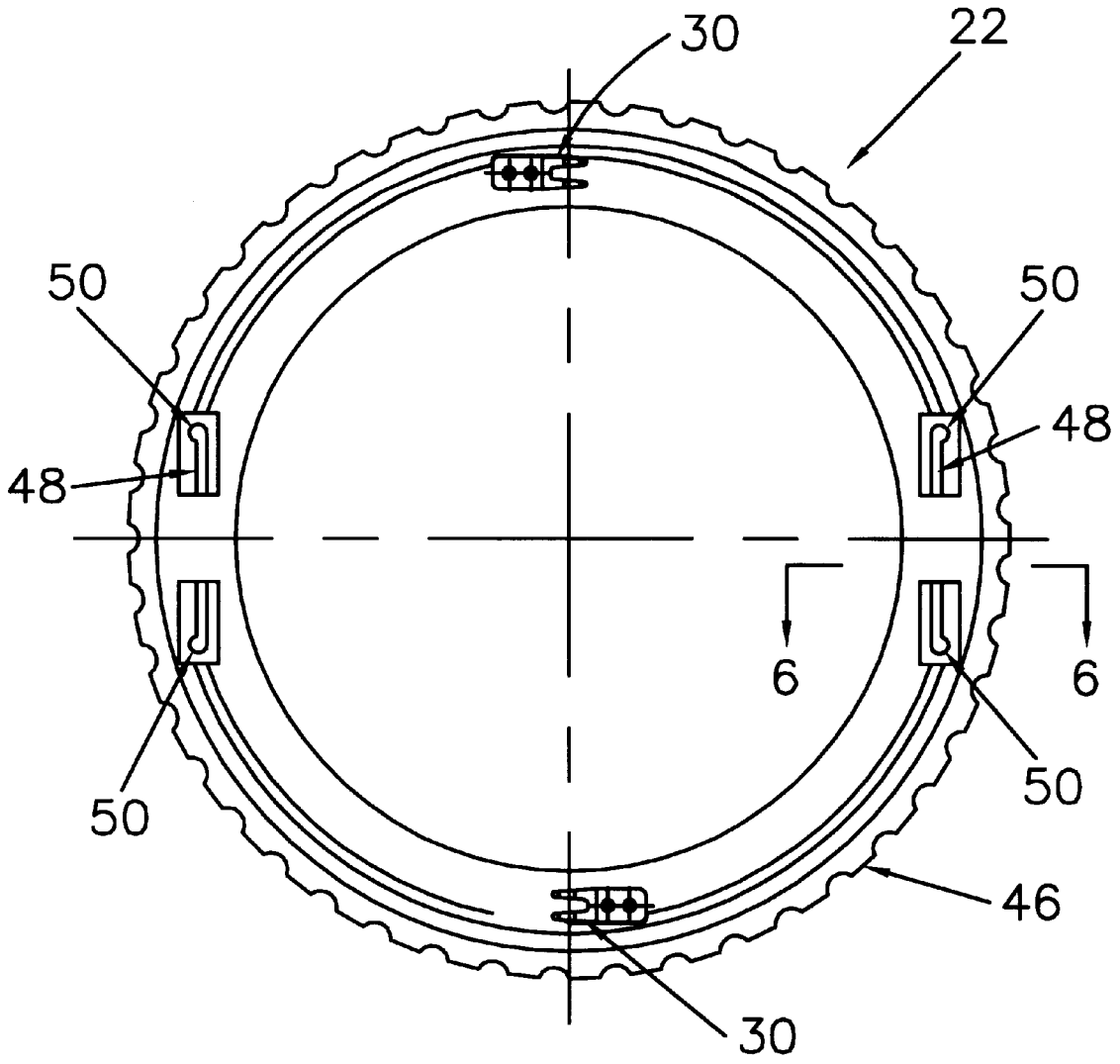
FIG. 5 illustrates an embodiment of a setting member adapted for use in the timer embodiment shown in FIG. 1.
Figure 6:
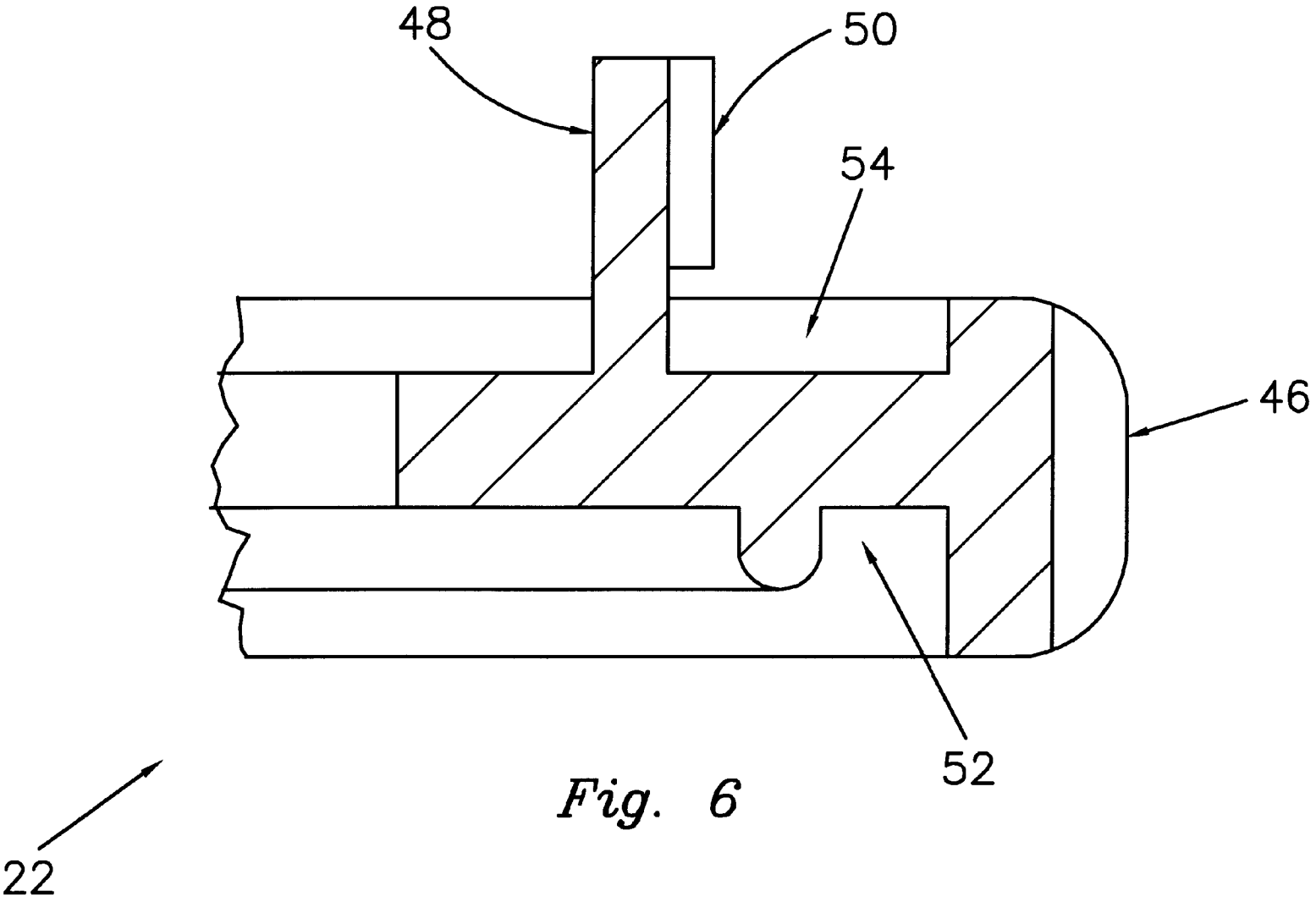
FIG. 6 shows a cross-sectional side view of a detail of the setting member embodiment shown in FIG. 5.

Referring now to FIG. 5 and FIG. 6, details of setting dial 22 are illustrated. As shown, two bit generator contacts 30 are provided at about 180° apart from one another. They are positioned on the same surface of setting dial 22 that lies adjacent to printed circuit board 26 as shown in FIG. 3. Setting dial 22 is provided with an outer dial surface 46 that preferably includes ornamental contours, as shown. Perhaps most clearly shown in FIG. 6, setting dial 22 includes a pair of flanges 48 which extend outwardly from the surface of the dial opposite to the surface on which bit generator contacts 30 are mounted. Flanges 48 are separated by about 180° and include outwardly extending detents 50. These detents are positioned to contact an internal surface of back housing 18, as will be described later with reference to FIG. 8.

Referring specifically to FIG. 6, setting dial 22 includes a front housing groove 52 positioned to accept front housing edge portion 24 of front housing 16. Setting dial 22 also includes a back housing groove 54 positioned to accept a similar portion of back housing 18 (see FIG. 8). As illustrated in FIG. 6, flange 48 and detent 50 are positioned to contact the interior surface of back housing 18.

Figure 7A:
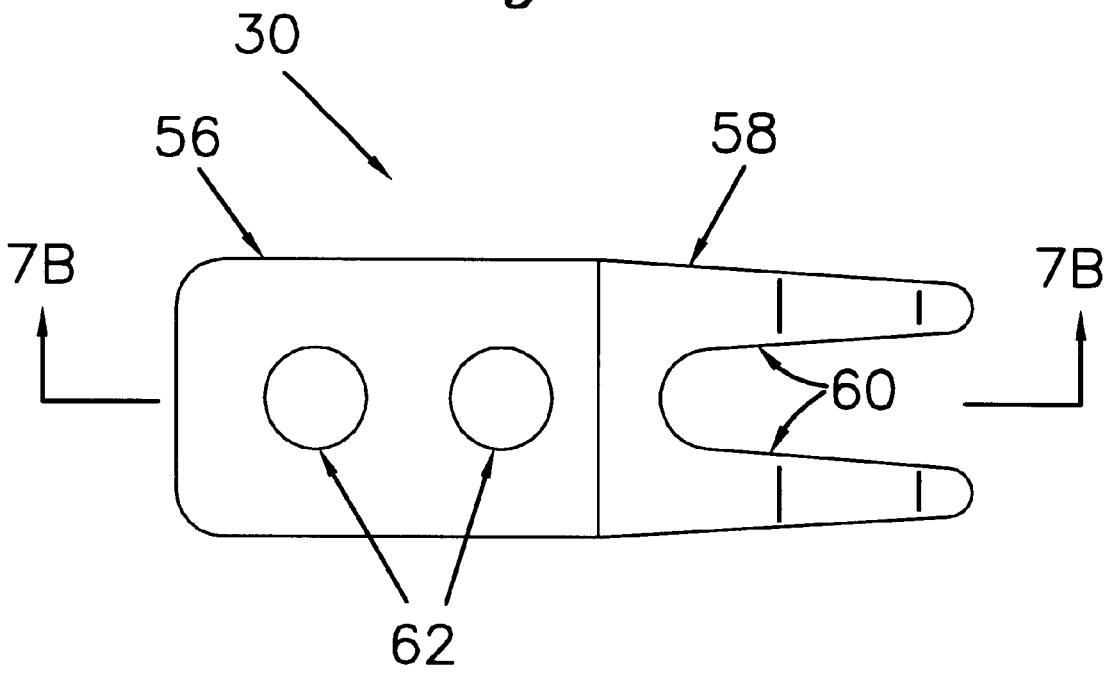
FIG. 7A shows a top view of an embodiment of a contact adapted for use in the timer embodiment shown in FIG. 1.
Figure 7B:
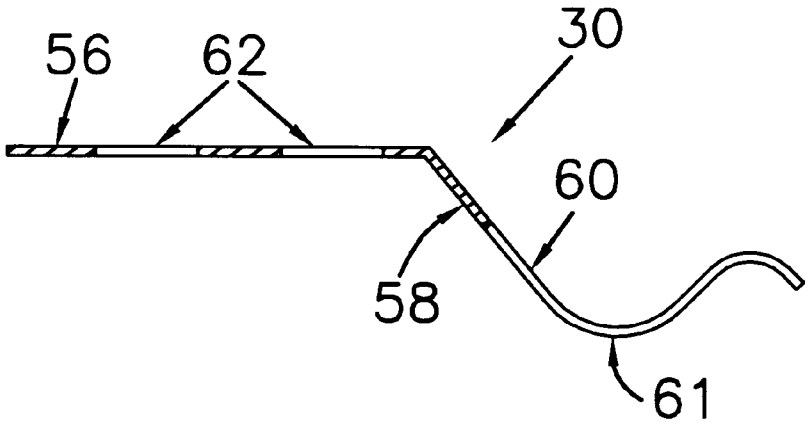
FIG. 7B shows a cross-sectional side view of the contact embodiment shown in FIG. 7A.

FIGS. 7A and 7B illustrate details of a preferred bit generator contact 30 that forms a component of setting dial 22. Bit generator contact 30 includes a mounting portion 56 and a contact portion 58 that terminates in two prongs 60. Formed in mounting portion 56 are two mounting holes 62. Mounting holes 62 provide a means for attaching bit generator contact 30 to setting dial 22. In a preferred embodiment, setting dial 22 is formed from a plastic material which melts into mounting holes 62 of bit generator contact 30 during attachment, thereby capturing bit generator contact 30 and holding it in place.

The contour of bit generator contact 30 is most clearly illustrated in FIG. 7B. Contact portion 58 extends at an angle away from the plane of mounting portion 56 and prongs 60 are provided with a bend to define a contact point 61. It is this contact point 61 of each prong 60 that contacts the surface of printed circuit board 26. Bit generator contacts 30 are most preferably formed from steel sheet, although other materials are of course contemplated.

Various internal features of timer 10 will now be described as they relate to its operation. Referring to FIG. 8, which illustrates internal details of back housing 18, a number of detents 64 are positioned on its interior surface to project toward the interior of timer 10. Detents 64 are positioned adjacent to a back housing mounting portion 66, which is sized and shaped to fit within back housing groove 54 of setting dial 22 shown in FIG. 6.

When setting dial 22 is assembled with back housing 18, the detents 50 positioned on the flanges 48 of setting dial 22 contact the detents 64 formed on the interior surface of back housing 18. Discrete rotational positions of setting dial 22 with respect to back housing 18 and timer 10 are defined by the engagement of detents 50 between adjacent detents 64. In other words, setting dial 22 can be rotated through discrete positions as detents 50 are engaged and released by adjacent detents 64.

In the preferred embodiment selected for illustration, back housing 18 is provided with fifty-six (56) detents 64, thereby defining fifty-six (56) discrete rotational positions for setting dial 22 with respect to timer 10. These discrete positions, as they relate to bit generator pattern 38, are designated in FIG. 9 by the numerals "1" through "56" around the circumference of bit generator pattern 38. Examples of five illustrative positions are labeled "A" through "E" in FIG. 9.

As described with reference to FIG. 4, bit generator pattern 38 includes a continuous contact 40 and spaced contacts 42A–42N. Although not shown in FIG. 9, spaced contacts 42A–42G are preferably interconnected, most preferably on the reverse side of PC board 26, in a first "hemisphere" designated "PO". Similarly, spaced contacts 42H–42N are preferably interconnected in a second "hemisphere" designated "Pl".

As setting dial 22 is rotated with respect to timer 10, bit generator contacts 30 are moved into and across the discrete positions "1" through "56" and, depending upon the positions of bit generator contacts 30 with respect to bit generator pattern 38, close or open a circuit between continuous contact 40 and spaced contacts 42A–42N.

If we use "0" to indicate an open circuit between a bit generator contact 30 and a spaced contact 42A–42N and "1" to indicate a closed circuit, we can illustrate the logic table of bit generator pattern 38 for illustrative positions "A" through "E" as follows:

| Position | A | B | C | D | E |
|---|---|---|---|---|---|
| Hemisphere PO | 0 | 1 | 1 | 0 | 0 |
| Hemisphere P1 | 0 | 0 | 1 | 1 | 0 |

Because bit generator pattern 38 faces towards the rear of timer 10, counter-clockwise rotation of setting dial 22 moves the contacts 30 from position "A" to position "E". Accordingly, the logic pattern illustrated in the logic table in the direction from position "A" to position "E" is a decrement pattern. Conversely, movement of setting dial 22 in a clockwise-direction moves the contacts 30 from position "E" to position "A". Accordingly, the reverse logic pattern illustrated in the logic table in the direction from position "E" to position "A" is an increment pattern.

Figure 10:
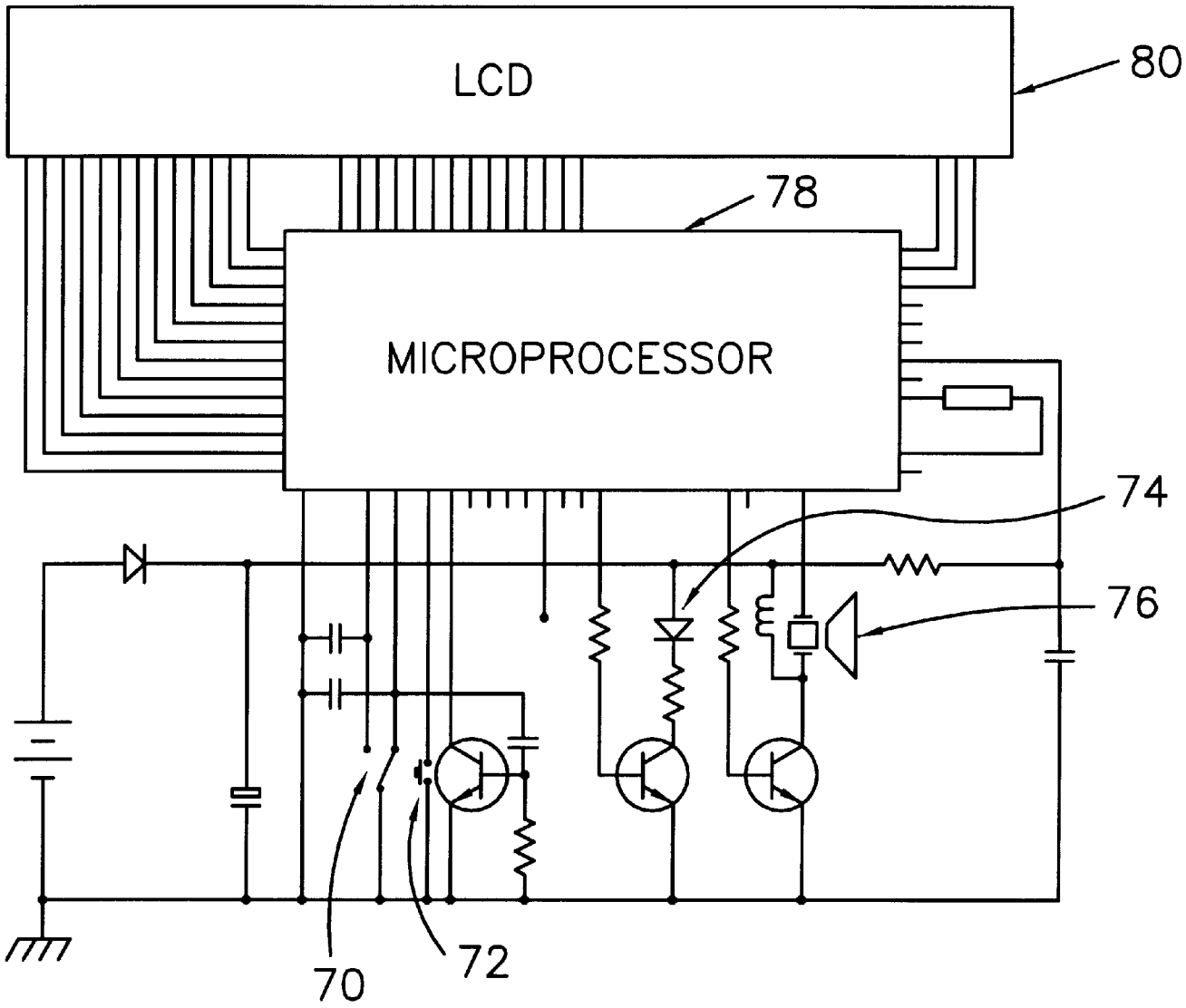
FIG. 10 is an embodiment of a circuit adapted for use in a timer according to this invention.

FIG. 10 illustrates a circuit that is adapted for use in timer 10. It is connected to bit generator pattern 38 in such a way as to detect clockwise and counter-clockwise rotation of setting dial 22. Referring to FIG. 10, a switch 70 is connected to bit generator 38 and a switch 72 provides a pause. A visual alarm in the form of LED 14 is provided at diode 74 and the audible alarm is provided at 76. Item 78 is a microprocessor chip selected for use with timer 10. Many such chips 78 are commonly available. Item 80 is a liquid crystal display that forms display 12.

An alternative method and arrangement for generating and processing of electrical impulses is described by Arnold Werner et al in U.S. Pat. No. 4,263,596, which is incorporated herein by reference. It illustrates an impulse generator with impulse-generating elements. Other configurations are contemplated as well.

A preferred internal operation of timer 10 will now be described with general reference to all of the drawings. In order to activate timer 10 and to set a desired countdown time, setting dial 22 is rotated in a clockwise direction. During such rotation, bit generator contacts 30 on setting dial 22 are swept over the surface of printed circuit board 26. One prong 60 of each of the bit generator contacts 30 is positioned to maintain contact with the continuous conductor 40 on printed circuit board 26. The other prong 60 is positioned for sweeping contact with spaced conductors 42A–42N. Accordingly, as bit generator contacts 30 are moved over the surface of printed circuit board 26, an intermittent closed circuit between the continuous conductor 40 and spaced conductors 42A–42N occurs, resulting in an appropriate signal being generated in microprocessor 78. It is the order of these intermittent closed circuits that allows for incrementing or decrementing of the set countdown time by microprocessor 78.

Timer 10 is adapted so that clockwise rotation of setting dial 22 increases or increments the set countdown time while counter-clockwise rotation of setting dial 22 decreases or decrements the set countdown time. Specifically, clockwise rotation of setting dial 22 with respect to the face of timer 10 generates an increment pattern such as the one described with reference to FIG. 9. This increment pattern causes switch 70, chip 78 and LCD 80 to increment the countdown time displayed by display 12. Conversely, counter-clockwise rotation of setting dial 22 with respect to the face of timer 10 generates a decrement pattern, as described, and causes switch 70, chip 78 and LCD 80 to decrement the countdown time displayed by display 12.

Upward and downward adjustment of the countdown time can be accomplished even during the countdown mode by rotating setting dial 22 clockwise or counter-clockwise, respectively. This preferred feature is quite helpful when there is a desire to change the countdown time "on the fly".

While a preferred embodiment of this invention has been described with reference to the drawings, it will be appreciated that many modifications can be made without departing from the spirit or scope of the invention. For example, the various components of the timer can be formed using various materials and configurations. Although it is preferred that a setting dial is positioned about the perimeter of the timer's housing, the dial is optionally replaced with any setting member that can be positioned against any surface of the housing or timer body so long as its movement causes intermittent electrical short circuits. Although rotational movement of a dial is preferred, it is contemplated that rotational movement can be replaced with linear or any other type of movement and that the conductors can be positioned in any manner on any surface of a timer or timer component.

In any embodiment, the timer of this invention has several significant benefits. It permits a user to set a countdown time simply and efficiently. It also permits the user in a preferred embodiment to easily adjust the countdown time to increase or decrease its duration while the timer is operating in a countdown mode. Although these features are clearly useful in the kitchen, they provide significant benefits in many other applications as well.

What is claimed is:

1. An electronic timer for displaying an operator-selected countdown time and for decrementing said countdown time in a countdown mode, wherein said countdown time is easily set and adjusted, said electronic timer comprising:

a timer body having a display for indicating said countdown time;

a setting member attached to said timer body for rotational movement with respect to said timer body, said setting member being rotatable in a direction to generate an increment pattern and being rotatable in an opposite direction to generate a decrement pattern;

a bit generator circuit mounted within said timer body and adjacent to said setting member for receiving said increment pattern and said decrement pattern generated by said rotational movement of said setting member, said bit generator circuit also being connected to said display for incrementing said countdown time in response to said increment pattern and decrementing said countdown time in response to said decrement pattern, said bit generator circuit having a circumferential bit generator pattern having a first bit generator and a second bit generator diposed on opposing hemispheres of said circumferential bit generator pattern;

wherein said first bit generator and said second bit generator establish open and closed circuits upon rotational movement of said setting member forming a logic pattern;

wherein said bit generator circuit translates said logic pattern from said rotational movement of said setting member into a signal for incrementing or decrementing said countdown time;

wherein said display indicates said countdown time as it decrements from said operator-selected countdown time in said countdown mode; and wherein said countdown time is adjustable as it decrements during said countdown mode by rotation of said setting member to increment or decrement said countdown time.

2. The electronic timer defined in claim 1, wherein said setting member comprises a ring-shaped dial, an outer edge of said dial extending radially outwardly from said timer body for manipulation by a user of said timer, and an inner edge of said dial extending radially inwardly toward an interior of said timer body for at least intermittent contact with said bit generator circuit.

3. The electronic timer defined in claim 1, wherein said display comprises a liquid crystal display.

4. The electronic timer defined in claim 1, further comprising an alarm connected to said bit generator circuit, wherein said alarm is actuated upon lapse of said countdown time.

5. The electronic timer defined in claim 4, said alarm comprising an audible and visual indication of lapsed countdown time.

6. The electronic timer defined in claim 1, further comprising a foot switch connected to said timer body for pausing said decrement of said countdown time.

7. The electronic timer defined in claim l, wherein said display is positioned on a face of said timer body and said setting member extends radially outwardly with respect to said face.

8. The electronic timer defined in claim 1, wherein said display comprises a digital display of said countdown time in minutes and hours.

9. An electronic timer for displaying an operator-selected countdown time and for decrementing said countdown time in a countdown mode, wherein said countdown time is easily set and adjusted, said electronic timer comprising:

a timer body having a display for indicating said countdown time;

setting means attached to said timer body for generating an increment pattern and a decrement pattern, said setting means being mounted for rotational movement with respect to said timer body in a direction to generate said increment pattern and being mounted for rotational movement in an opposite direction to generate said decrement pattern;

a circuit mounted within said timer body and adjacent to said setting means for receiving said increment pattern and said decrement pattern generated by said rotational movement of said setting means, said circuit also being connected to said display for incrementing said countdown time in response to said increment pattern and decrementing said countdown time in response to said decrement pattern, said bit generator circuit having a circumferential bit generator pattern having a first bit generator and a second bit generator diposed on opposing hemispheres of said circumferential bit generator pattern;

wherein said first bit generator and said second bit generator establish open and closed circuits upon rotational movement of said setting member forming a logic pattern;

wherein said circuit translates said logic pattern from said rotational movement of said setting means into a signal for incrementing or decrementing said countdown time;

wherein said display indicates said countdown time as it decrements from said operator-selected countdown time in said countdown mode; and wherein said countdown time is adjustable as it decrements during said countdown mode by rotation of said setting means to increment or decrement said countdown time.

10. The electronic timer defined in claim 9, wherein said setting means comprises a ring-shaped dial, an outer edge of said dial extending radially outwardly from said timer body for manipulation by a user of said timer, and an inner edge of said dial extending radially inwardly toward an interior of said timer body for at least intermittent contact with said circuit.

11. The electronic timer defined in claim 9, wherein said display comprises a liquid crystal display.

12. The electronic timer defined in claim 9, further comprising an alarm connected to said circuit, wherein said alarm is actuated upon lapse of said countdown time.

13. The electronic timer defined in claim 12, said alarm comprising an audible and visual indication of lapsed countdown time.

14. The electronic timer defined in claim 9, further comprising a foot switch connected to said timer body for pausing said decrement of said countdown time.

15. The electronic timer defined in claim 9, wherein said display is positioned on a face of said timer body and said setting means extends radially outwardly with respect to said face.

16. The electronic timer defined in claim 9, wherein said display comprises a digital display of said countdown time in minutes and hours.

17. An electronic timer for displaying an operator-selected countdown time and for decrementing said countdown time in a countdown mode, wherein said countdown time is easily set and adjusted, said electronic timer comprising:

a timer body having a display for indicating said countdown time, said display being positioned on a face of said timer body;

a setting member attached to said timer body for rotational movement with respect to said timer body, said setting member being rotatable in a direction to generate an increment pattern and being rotatable in an opposite direction to generate a decrement pattern, said setting member comprising a dial having an outer edge portion extending radially outwardly from said timer body and radially outwardly with respect to said face of said timer body for manipulation by a user of said timer and having an inner edge portion extending radially inwardly toward an interior of said timer body;

a bit generator circuit mounted within said timer body and adjacent to said setting member for receiving said increment pattern and said decrement pattern generated by said rotational movement of said setting member, said bit generator circuit also being connected to said display for incrementing said countdown time in response to said increment pattern and decrementing said countdown time in response to said decrement pattern, said bit generator circuit having a circumferential bit generator pattern having a first bit generator and a second bit generator diposed on opposing hemispheres of said circumferential bit generator pattern;

wherein said first bit generator and said second bit generator establish open and closed circuits upon rotational movement of said setting member forming a logic pattern;

wherein said bit generator circuit translates said said logic pattern from said rotational movement of said setting member into a signal for incrementing or decrementing said countdown time;

wherein said display indicates said countdown time as it decrements from said operator-selected countdown time in said countdown mode; and wherein said countdown time is adjustable as it decrements in said countdown mode by rotation of said setting member to increment or decrement said countdown time.

18. The electronic timer defined in claim 17, wherein said display comprises a liquid crystal display including a digital display of said countdown time in minutes and hours.

19. The electronic timer defined in claim 17, further comprising an alarm connected to said bit generator circuit, wherein said alarm is actuated upon lapse of said countdown time, said alarm comprising an audible or visual indication of lapsed countdown time.

20. The electronic timer defined in claim 17, further comprising a foot switch connected to said timer body for pausing said decrement of said countdown time.

* * * * *